US005845590A

United States Patent [19]

Seidl

[11] Patent Number: 5,845,590

[45] Date of Patent: Dec. 8, 1998

[54] ADJUSTABLE HEIGHT TABLE

[75] Inventor: Lon D. Seidl, Green Bay, Wis.

[73] Assignee: Krueger International, Inc., Green Bay, Wis.

[21] Appl. No.: 875,364

[22] PCT Filed: Jan. 31, 1995

[86] PCT No.: PCT/US95/01278

§ 371 Date: Jul. 24, 1997

§ 102(e) Date: Jul. 24, 1997

[87] PCT Pub. No.: WO96/23433

PCT Pub. Date: Aug. 8, 1996

[51] Int. Cl.[6] ..... A47B 9/00

[52] U.S. Cl. ..... 108/147; 108/144.11

[58] Field of Search ..... 108/144.11, 147, 108/147.19; 248/188.4, 188.5

[56] References Cited

U.S. PATENT DOCUMENTS

| | | | |
|---|---|---|---|
| 732,367 | 6/1903 | Melville . | |
| 1,943,280 | 1/1934 | Arnold . | |
| 4,315,466 | 2/1982 | Boerigter | 108/147 |
| 4,590,865 | 5/1986 | Rutsche et al. | 108/147 X |
| 4,593,874 | 6/1986 | Dunagan . | |
| 4,627,364 | 12/1986 | Klein et al. . | |
| 4,635,565 | 1/1987 | Novak | 108/147 |
| 4,981,085 | 1/1991 | Watt | 108/147 |
| 5,289,782 | 3/1994 | Rizzi et al. . | |
| 5,322,025 | 6/1994 | Sherman et al. . | |
| 5,337,678 | 8/1994 | Grout | 108/147 |
| 5,447,099 | 9/1995 | Adams et al. | 108/147 |
| 5,598,789 | 2/1997 | Jonker | 108/147 |
| 5,601,037 | 2/1997 | Meyer et al. | 108/147 |

FOREIGN PATENT DOCUMENTS 2133683 8/1984 United Kingdom .

*Primary Examiner*—Jose V. Chen

*Attorney, Agent, or Firm*—Andrus, Sceales, Starke & Sawall

[57] ABSTRACT

An adjustable height table assembly consists of a table top (12) and an adjustable leg (20) and base (14) structure to which the table top is mounted. The leg and base structure includes a leg to which the table top (12) is mounted, and a base (14) to which the leg (20) is mounted for vertical movement. The base (14) includes a pair of vertical guide shafts (52, 54), and a bearing assembly (73) is secured to the leg and mounted to the guide shafts for providing vertical movement of the leg relative to the base. An adjustment mechanism includes a lead screw (86) extending through the leg and threadedly engaged with a lead nut (70) secured to the base between the guide shafts, and a chain (108) and sprocket (90, 92) system selectively imparts rotation to the lead screw upon manual operation of a crank (106). The spaced guide shafts (52, 54) provide a high degree of stability to the leg and table top, even when the table top is raised to its upward most position. The chain (108) and sprocket mechanism (90, 92) for imparting rotation to the lead screw enables the drive sprocket to be positioned in any location relative to the top.

23 Claims, 2 Drawing Sheets

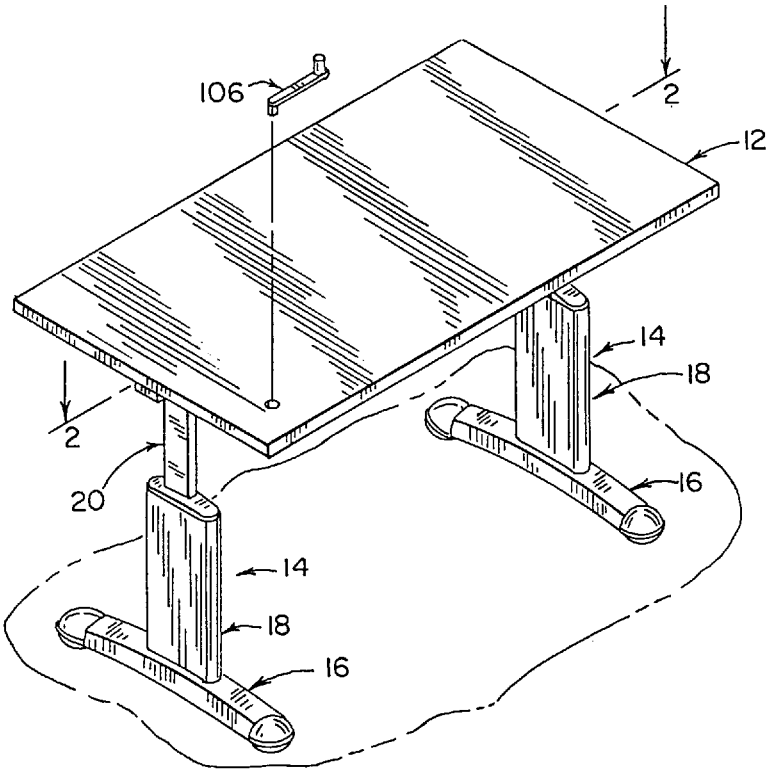
FIG. 1
FIG. 2
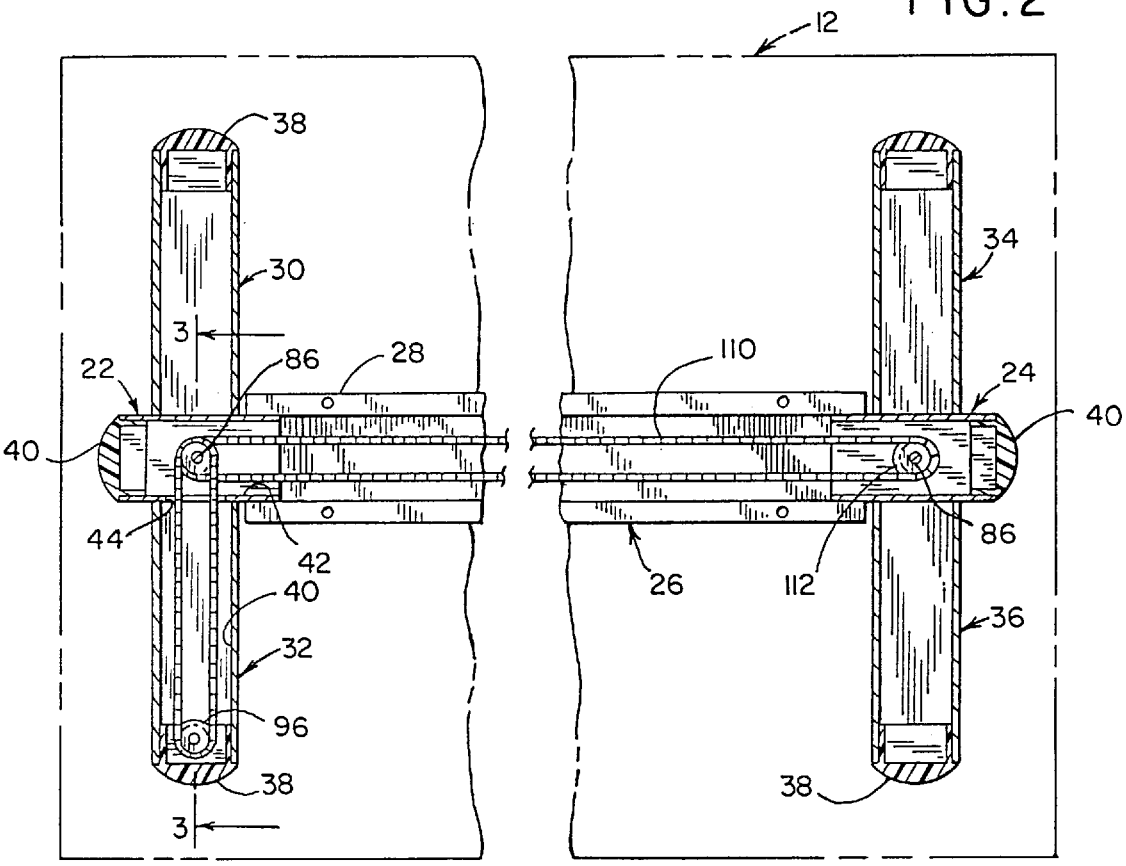

FIG. 3
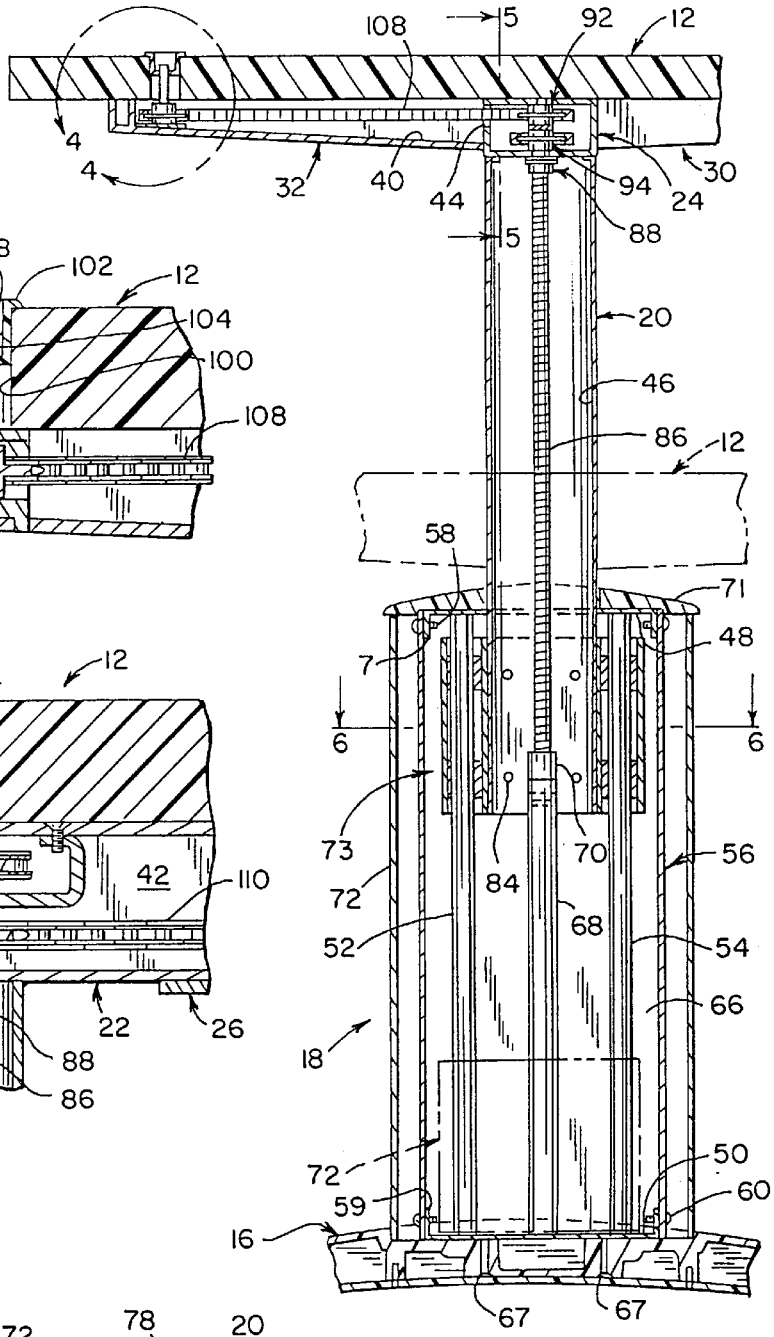
FIG. 4
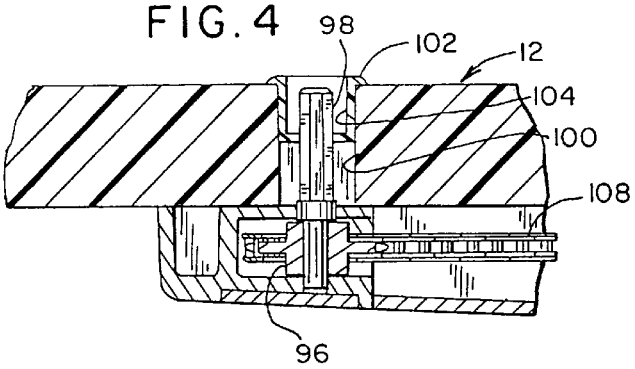
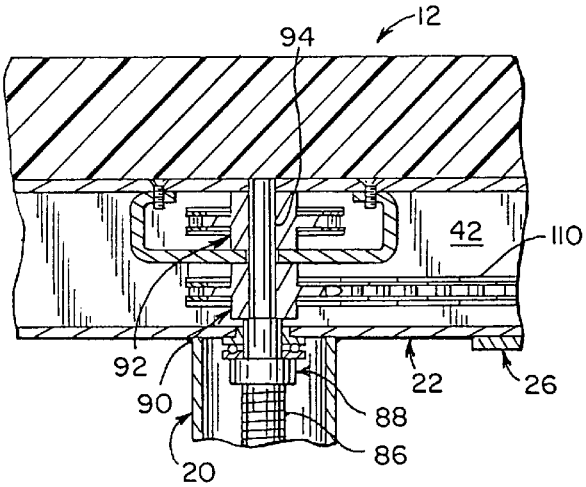
FIG. 5
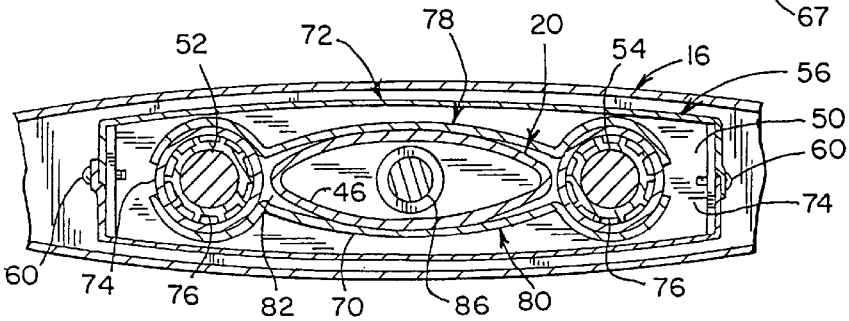
FIG. 6

ADJUSTABLE HEIGHT TABLE

BACKGROUND AND SUMMARY OF THE INVENTION

This invention relates to a table assembly in which the table top is movable to varying elevations above a supporting surface such as a floor.

It is known to construct a table in such a manner that the table top is movable to varying elevations above a supporting surface such as floor. Tables of this type conventionally include a table top and a base assembly having a lower stationary portion engageable with the floor and an upper portion, to which the table top is secured, movably mounted to the stationary lower portion. An adjustment mechanism is provided for fixing the position of the upper portion of the base relative to the lower portion, for adjusting the height of the table relative to the floor. Many types of adjustment mechanisms are known for adjusting the vertical position of the upper base portion relative to the lower base portion.

It is an object of the present invention to provide an improved adjustable height table assembly in which the upper base portion is movably secured to the lower base portion so as to provide an extremely stable support for the table top, even when the table top is in its uppermost position above the floor. It is a further object of the invention to provide a compact and easily assembled arrangement for movably mounting the base upper portion to the lower portion, while maintaining a smooth and stable arrangement. Yet another object of the invention is to provide an operating mechanism for turning a rotatable threaded member forming a part of the height adjustment mechanism, in which the operating mechanism can be placed in most any location on the table top.

In accordance with one aspect of the invention, a table assembly includes a table top and a pair of spaced base assemblies, each of which includes a foot engageable with a supporting surface such as the floor, extending in a front-rear direction. Each base further includes a pair of vertical guide members spaced from each other in the front-rear direction, and a bearing or slide assembly is slidably mounted to the guide members. A table top support forms the movable upper portion of the base to which the table top is mounted, and includes a vertical leg member fixedly mounted to the bearing assembly. The base assembly includes a housing mounted to the foot member and extending upwardly therefrom. The housing encloses the vertical guide members and the bearing assembly, and the vertical member of the table top support extends outwardly from an upper end defined by the housing.

A vertical adjustment: mechanism is interconnected between the base and the table top support, for adjusting the vertical position of the table top relative to the floor. The vertical adjustment mechanism includes a rotatable threaded member, such as a lead screw, extending through a passage defined by the vertical leg member of the table top support. A tubular member is mounted within the housing between the vertical guide members, and receives the lower portion of the lead screw. A fixed threaded member, such as a lead nut, is mounted toward the upper end of the tubular member and is threadedly engaged with the threads of the lead screw.

The table top support further includes an arm to which the table top is secured. The arm defines an axial passage, which is in communication with the passage formed in the vertical leg member through which the lead screw extends. A driven sprocket is mounted to the lead screw toward its upper end, and a drive sprocket is rotatably mounted to the arm below the table top. A chain is engaged with the drive sprocket and with the driven sprocket, and a manually operable crank provides rotation of the drive sprocket, which is transferred through the chain and the driven sprocket to impart rotation to the lead screw and to thereby adjust the height of the table top.

The base housing is preferably formed so as to include an upper wall and a lower wall, with upper and lower ends of the vertical guide members being secured to the upper and lower walls, respectively. The tubular member, which receives the lower end of the lead screw, is also mounted to the lower wall of the housing. The housing lower wall is secured to an upwardly facing surface defined by the foot, for rigidly mounting the housing, and thereby the vertical guide members, to the foot.

The bearing assembly includes a pair of bearing members, each of which defines an axial passage within which one of the vertical guide members is received, and shell structure secured to the bearing members and to the lower end of the vertical support member.

The invention thus contemplates an improved and advantageous structure for mounting the adjustable portion of a table base to the stationary portion, as well as an improved chain-driven actuator mechanism for imparting rotation to a lead screw forming a part of a table top height adjustment mechanism. These aspects of the invention can be satisfactorily used independently of each other. However, in a particularly preferred embodiment both aspects are incorporated into a single adjustable height table assembly for providing highly advantageous construction and operation.

The invention further contemplates a method of making an adjustable base for a table assembly, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is an isometric view showing an adjustable height table assembly constructed according to the invention;

FIG. 2 is a partial top plan view of the operating mechanism for the adjustable height table assembly of FIG. 1;

FIG. 3 is a partial longitudinal section view, taken generally along line 3—3 of FIG. 2;

FIG. 4 is an enlarged partial section view of the portion of FIG. 3 encircled at 4—4;

FIG. 5 is a partial section view taken along line 5–5 of FIG. 3; and FIG. 6 is a partial section view taken along line 6—6 of FIG. 3.

DETAILED DESCRIPTION OF THE INVENTION

Referring to FIG. 1, an adjustable height table assembly 10 generally consists of a table top 12 and a pair of base assemblies 14. Each base assembly 14 includes a foot 16 extending in a front-rear direction, a housing 18 mounted to and extending upwardly from foot 16, and a vertical leg 20 secured to table top 12 and movably mounted to housing 18, in a manner to be explained.

Referring to FIG. 2, a pair of open-ended hubs 22, 24 are mounted to the upper ends of legs 20. An H-shaped frame assembly 22 is mounted to the underside of table top 12. A channel member 26 extends between hubs 22, 24, and includes flanges 28 through which threaded screws extend for securing channel member 26 to the underside of table top 12. A pair of channel-shaped arms 30, 32 extend in opposite directions from hub 22, and channel-shaped arms 34, 36 extend in opposite directions from hub 24. End caps 38 are engaged with the ends of arms 30–36, and end caps 40 are engaged with the outer ends of hubs 22, 24.

Arms 30, 32 and 34, 36 are welded at their inner ends to the side walls of hubs 22, 24, respectively. Each of arms 30–36 defines an internal passageway over which table top 12 lies. The internal passageway of arm 32, shown at 40, is in communication with the internal channel defined by hub 22, shown at 42, via an opening 44 formed in the side wall of hub 22.

As shown in FIG. 3, a leg 20 is mounted to the lower wall of each of hubs 22, 24. Leg 20 may assume any satisfactory shape or form, such as rectangular or elliptical tubing or the like. Leg 20 defines an internal passage 46 extending between its open upper and lower ends.

Referring to FIG. 3, the housing 18 of each base assembly 14 includes an inner housing subassembly consisting of an upper bracket 48 and a lower bracket 50, with vertical guide shafts 52, 54 extending between brackets 48 and 50. Brackets 48 and 50 define aligned openings which received reduced-diameter end portions of guide shafts 52, 54. A peripheral wall assembly 56 (FIGS. 3, 6) forms the inner housing in combination with upper bracket 48 and lower bracket 50, and is secured at its upper end to downturned end portions 57 of upper bracket 48 via screws 58, and is secured at its lower end to upturned end portions 59 of lower bracket 50 via screws 60. In this manner, wall structure 56 in combination with upper bracket 48 and lower bracket 50 defines an enclosure or inner housing having an internal cavity 66 through which guide shafts 52, 54 extend.

As shown in FIG. 3, the housing subassembly defined by upper bracket 48, lower bracket 50, shaft 52, 54 and wall structure 56 is secured to foot 16 by threaded fasteners extending upwardly through vertical passages 67 formed in foot 16, with threaded nuts being engaged with lower bracket 50 and with the threaded fasteners.

A tube 68 is mounted at its lower end to lower bracket 50 between guide shafts 52, 54, and a lead nut 70 is mounted to the upper end of tube 68.

As shown in FIG. 3, a top cap or grommet is positioned over upper bracket 48, and a depending peripheral oval wall structure 72 encloses wall structure 56 between top cap 71 and leg 16. Top cap 71 and wall 72 are primarily ornamental, serving to enclose the functional internal components of housing 18.

As shown in FIGS. 3 and 6, a slide or bearing assembly 73 is received within internal cavity 66. Bearing assembly 73 includes a pair of bearing tubes 74 into which low-friction bearing members 76 are press-fit. Bearing members 76 are constructed of any satisfactory low-friction material, such as Duralon, and are arranged relative to tubes 74 such that one bearing member 76 is located toward the upper end of tube 74 and another bearing member 76 is located toward the lower end of tube 74. Bearing members 76 define axial passages within which guide shafts 52, 54 are received, for slidably mounting bearing tubes 74 to guide shafts 52, 54.

As shown in FIG. 6, a pair of mirror-image shell members 78, 80 are mounted to bearing tubes 74, such as by welding, to form a one-piece bearing assembly 73 defining a vertical passageway through bearing assembly 73. Bearing members 76 function to slidably mount bearing assembly 73 to guide shafts 52, 54 for vertical movement upwardly and downwardly on shafts 72, 74.

Bearing assembly 73 is mounted to the lower end of leg 20 via bolts or the like extending through aligned openings, such as shown at 84 (FIG. 3) formed in shell members 78, 80 and in the side walls of leg 20. In this manner, table top 12 is mounted for upward and downward vertical movement to housing 18 by upward and downward movement of bearing assembly 73 on guide shafts 52, 54.

Referring to FIGS. 3, 4 and 5, a height adjustment mechanism includes a lead screw 86 extending through passage 46 in leg 20 and threadedly engaged with lead nut 70 mounted to the upper end of tube 68. Lead screw 86 is rotatably mounted at its upper end to the lower wall of hub 24 via a bearing assembly 88. An idler sprocket 90 and a driven sprocket 92 are fixed to an upper extension 94 of lead screw 86. Extension 94 and sprockets 90, 92 have mating irregular cross-sections, so as to non-rotatably mount sprockets 90 and 92 to lead screw 86. The upper end of extension 94 is rotatably mounted by a suitable bushing or the like to the upper wall of hub 24.

Referring to FIG. 4, a drive sprocket 96 is mounted to end cap 38, which in turn is secured to the end of arm 32. A drive shaft 98 extends upwardly through a passage 100 formed in table top 12, terminating flush with or slightly below the upper surface of table top 12. A grommet 102 is received within the upper portion of opening 100, and defines a recess 104 into which the upper end of drive shaft 98 extends. A manually operable crank 106 (FIG. 1) is removably engageable with drive shaft 98 from above table top 12.

As shown in FIGS. 2 and 6, a drive chain 108 extends between drive sprocket 96 and driven sprocket 92. A idler chain 110 (FIG. 2) extends between idler sprocket 90 and an idler sprocket 112 mounted to the upper end of a lead screw 86' identical to lead screw 86 associated with base assembly 14 at the opposite end of table assembly 10.

In operation, the height of table top 12 is adjusted by the operator first manually engaging crank 106 with the upper end of drive shaft 98. The operator then turns crank 106 to rotate drive sprocket 96, which in turn imparts rotation to driven sprockets 92 and 112 through chains 108 and 110, respectively. Lead screws 86, 86' are then rotated relative to lead nuts 70, to raise or lower table top 12. Engagement of bearing members 76 with spaced guide shafts 52, 54 throughout the range of motion of bearing assembly 73 provides stability in the adjustable height mounting of table top 12 relative to base assemblies 14. In addition, the use of a drive chain 108 to impart rotation to lead screw 86 enables a manufacturer to position the drive shaft 98 in any satisfactory location. In the preferred embodiment, drive shaft 98 is located adjacent the end of one of arms 30–36, but it is understood that drive shaft 98 could be in any other satisfactory location by simply providing a suitable housing for chain 108 and forming any openings as necessary in hub members 22, 24 and/or arms 30–36 to allow drive chain 108 to pass therethrough between drive sprocket 96 and driven sprocket. 92.

To construct table assembly 10, arms 30, 32 and leg 20 are first welded to hub 24 in a subassembly, which is then in turn movably assembled to housing 18 by mounting bearing assembly 73 to the lower end of leg 20 and movably mounting bearing assembly 73 to guide shafts 52, 54 and then assembling housing 18 together and mounting housing 18 to leg 16. These assembled components are then secured to the underside of table top 12 adjacent one of its ends, and a similar assembly is secured to the opposite end of table top 12. Chain 110 is then trained between sprockets 90 and 112, and chain channel 26 is cut to length and secured to the underside of table top 12 so as to enclose the portion of chain 110 extending between hubs 22, 24. In this manner, the distance between the leg and base assembles can be varied and the associated lead screws interconnected simply by altering the length of chain 110 and chain channel 26.

Various alternatives and embodiments are contemplated as being within the scope of the following claims particularly pointing out and distinctly claiming the subject matter regarded as the invention.

We claim:

1. A table, comprising:

a table top;

at least one base assembly comprising a foot member engageable with a supporting surface; a pair of spaced, stationary vertical guide rods; a bearing arrangement including a pair of spaced, vertical bearing passages, wherein each guide rod is slidably received within one of the bearing passages such that the bearing arrangement is vertically slidable on the guide rods; and a table top support mounted to the table top and including a vertical member fixedly mounted to the bearing arrangement; and a vertical position adjusting arrangement interconnected between the base assembly and the table top support for adjusting the vertical position of the table to relative to the supporting surface.

2. The table of claim 1, wherein the base assembly includes a housing mounted to the foot member and extending upwardly therefrom, wherein the housing encloses the vertical rods and the bearing arrangement, and wherein the table top support vertical member extends outwardly from an upper end defined by the housing.

3. A table, comprising:

a table top;

at least one base assembly comprising a foot member engageable with a supporting surface; a pair of vertical guide members spaced from each other; a bearing assembly slidably mounted to the guide members; a table top support mounted to the table top and including a vertical member fixedly mounted to the bearing assembly; a housing mounted to the foot member and extending upwardly therefrom, wherein the housing encloses the vertical guide members and the bearing assembly, and wherein the table top support vertical member extends outwardly from an upper end defined by the housing; and a vertical position adjusting arrangement interconnected between at least one of the base assemblies and its associated table top support for adjusting the vertical position of the table top relative to the supporting surface;

wherein the vertical position adjusting arrangement includes a rotatable threaded member extending through a passage defined by the table top support vertical member, a tubular member located between the pair of vertical guide members for receiving the rotatable threaded member, and a fixed member secured to the tubular member and threadably engaged with the threaded member.

4. The table of claim 3, wherein the vertical position adjusting arrangement further includes a driven sprocket mounted to the rotatable threaded member toward an upper end thereof; a drive sprocket rotatably mounted below the table top; a chain engaged with the drive sprocket and with the driven sprocket; and a manually operable crank interconnected with the drive sprocket for imparting rotation to the rotatable member through the driven sprocket and the chain upon rotation of the drive sprocket.

5. The table of claim 4, wherein the chain is disposed within a channel member mounted to the underside of the table top.

6. A table, comprising:

a table top;

at least one base assembly comprising a foot member engageable with a supporting surface; a vertical guide arrangement; a bearing assembly slidably mounted to the guide arrangement; and a table top support mounted to the table top and including a vertical member fixedly mounted to the bearing assembly; and a vertical position adjusting arrangement interconnected between the base assembly and the table top support for adjusting the vertical position of the table top relative to the support surface;

wherein the base assembly includes a housing mounted to the foot member and extending upwardly therefrom, wherein the housing encloses the vertical guide arrangement and the bearing assembly, and wherein the table top support vertical member extends outwardly from an upper end defined by the housing;

wherein the housing includes an inner housing assembly comprising an upper member and a lower member between which the guide arrangement extends and wall structure interconnecting the upper and lower members, and an outer housing assembly enclosing the inner housing.

7. In an adjustable table assembly including a table top, a base assembly interposed between the table top and a supporting surface, and an adjustment mechanism for selectively adjusting the vertical position of the table top relative to the supporting surface, the improvement comprising:

a pair of spaced, stationary vertical guide rods forming a part of the base assembly;

a table top support fixed to the table top and including a depending support member; and a bearing assembly fixed to the support member and including a pair of spaced, vertical bearing passages, wherein the vertical guide rods are engaged within the vertical bearing passages for guiding vertical movement of the depending support member relative to the base upon operation of the adjustment mechanism.

8. The improvement of claim 7, wherein the spaced guide rods and the bearing assembly are located within the interior of a housing spaced below the table top, wherein the depending support member is vertically movable relative to the housing upon movement of the bearing assembly on the vertical guide rods.

9. The improvement of claim 8, wherein the housing is mounted to and extends upwardly from a foot member engageable with the supporting surface.

10. The improvement of claim 8, wherein the depending support member is located between the spaced vertical guide members and defines an internal passage having a downwardly facing opening, and wherein the adjustment mechanism includes a rotatable threaded member extending within the support member internal passage.

11. An adjustable base assembly for a table having a table top, comprising:

a foot extending in a front-rear direction and adapted for engagement with a supporting surface;

a housing mounted to and extending upwardly from the foot;

a pair of vertical guide rods located within the housing, the guide rods being spaced from each other in a front-rear direction;

a bearing arrangement located within the housing and including a pair of spaced, vertical bearing passages, wherein each guide rod is slidably received within one of the bearing passages such that the bearing arrangement is slidably mounted to the vertical guide rods;

a support adapted for mounting to the table top and being fixedly secured to the bearing member; and an adjustable position mechanism for selectively adjusting the vertical position of the support relative to the supporting surface, wherein engagement of the bearing member with the guide rods functions to guide vertical movement of the support relative to the housing.

12. The base assembly of claim 11, wherein the housing defines an upper wall and a lower wall mounted to the foot, and wherein the vertical guide rods each define an upper end and a lower end secured to the housing upper and lower walls, respectively, and wherein the support extends upwardly from the housing upper wall.

13. An adjustable base assembly for a table, comprising:

a foot adapted for engagement with a supporting surface;

a housing mounted to and extending upwardly from the foot, wherein the housing defines an upper wall and a lower wall mounted to the foot;

a pair of vertical guide members located within the housing, the guide members being spaced from each other, wherein each guide member defines an upper end secured to the housing upper wall and a lower end secured to the housing lower wall;

a bearing member located within the housing and slidably mounted to the vertical guide members;

a support adapted for mounting to a table top and being fixedly secured to the bearing member;

an adjustable position mechanism for selectively adjusting the vertical position of the support relative to the supporting surface, wherein engagement of the bearing member with the guide members functions to guide vertical movement of the support relative to the housing, and wherein the adjustable position mechanism includes a rotatable threaded member rotatably mounted to the support; and a tubular member mounted to and disposed within the housing between the vertical guide members for receiving the rotatable threaded member.

14. The base assembly of claim 13, wherein the tubular member is mounted to the housing lower wall.

15. The base assembly of claim 11, wherein the support includes a depending vertical member to which the bearing arrangement is mounted.

16. The base assembly of claim 15, wherein the bearing arrangement includes first and second bearings, each of which defines one of the bearing passages, and a shell assembly interconnecting the bearings and mounted to the depending vertical member.

17. The base assembly of claim 11, wherein the support includes one or more upper mounting arms adapted to support the table top, and a depending vertical member extending downwardly from the one or more upper mounting arms.

18. An adjustable base assembly for a table, comprising:

a foot adapted for engagement with a supporting surface;

a housing mounted to and extending upwardly from the foot;

a pair of vertical guide members located within the housing;

a bearing member located within the housing and slidably mounted to the vertical guide members;

a support adapted for mounting to a table top and being fixedly secured to the bearing member, wherein the support includes one or more upper mounting arms adapted to support the table top, and a depending vertical member extending downwardly from the one or more upper mounting arms; and an adjustable position mechanism for selectively adjusting the vertical position of the support relative to the supporting surface, wherein engagement of the bearing member with the guide members functions to guide vertical movement of the support relative to the housing, wherein the upper mounting arm and the depending vertical member define communicating passageways, and wherein the adjustable position mechanism includes a rotatable threaded member disposed within the passageway defined by the depending vertical member and an actuator mechanism including a drive arrangement disposed within the passageway defined by the upper mounting arm.

19. The base assembly of claim 18, wherein the actuator mechanism drive arrangement includes a drive sprocket rotatably mounted to the upper mounting arm, a driven sprocket mounted to the rotatable threaded member, and a chain drivingly engaged with the drive sprocket and the driven sprocket.

20. The base assembly of claim 19, further comprising a crankshaft mounted to the drive sprocket and adapted to be received within an opening formed in the table top for selective engagement by a manually operated crank.

21. A table, comprising:

a table top;

a base engageable with a supporting surface; and an adjustment arrangement associated with the base for adjusting the vertical position of the table top relative to the supporting surface, comprising a rotatable threaded member interconnected between a stationary portion of the base engageable with the supporting surface and an adjustable portion of the base to which the table top is mounted, and an operating mechanism for selectively imparting rotation to the rotatable threaded member, comprising:

a driven sprocket mounted toward an upper end of the threaded member;

a drive sprocket mounted for rotation below the table top;

a chain trained about the drive sprocket and about the driven sprocket, and a manually operable crank engageable with the drive sprocket for imparting rotation thereto, wherein rotation of the drive sprocket functions to impart rotation to the rotatable member through the chain and the driven sprocket;

wherein the adjustable portion of the base to which the table top is mounted includes an arm mounted below the table top and a depending vertical member to which the arm is mounted, wherein the chain extends through a passage formed in the arm and wherein the rotatable threaded member extends through a passage formed in the depending vertical member.

22. The operating mechanism of claim 21, wherein the threaded member is threadedly engaged with a mating threaded member mounted to the stationary portion of the base, wherein the mating threaded member is disposed between a pair of vertical guide members secured to the stationary portion of the base, and further comprising a bearing assembly secured to the adjustable portion of the base and engaged with the vertical guide members.

23. The operating mechanism of claim 21, wherein the table top includes an opening located over the drive sprocket, and further comprising a drive shaft mounted to the drive sprocket and extending into the opening, wherein the crank is removably engageable with the drive shaft.

* * * * *

UNITED STATES PATENT AND TRADEMARK OFFICE

CERTIFICATE OF CORRECTION

PATENT NO. : 5,845,590

DATED : December 8, 1998

INVENTOR(S) : LON D. SEIDL

It is certified that error appears in the above-indentified patent and that said Letters Patent is hereby corrected as shown below:

Claim 23, column 8, line 61, delete "21" and substitute therefor -- 22 --.

Signed and Sealed this

Twenty-fifth Day of May, 1999

*Attest:*

Q. TODD DICKINSON

*Attesting Officer*

*Acting Commissioner of Patents and Trademarks*